United States Patent [19]

Sauvey

[11] 4,413,544

[45] Nov. 8, 1983

[54] SINGLE CHANNEL STRING ENSEMBLE SOUND SYSTEM FOR AN ELECTRONIC MUSICAL INSTRUMENT

[75] Inventor: Donald R. Sauvey, Palatine, Ill.

[73] Assignee: The Marmon Group, Inc., Chicago, Ill.

[21] Appl. No.: 340,579

[22] Filed: Jan. 18, 1982

[51] Int. Cl.[3] ..... G10H 1/02

[52] U.S. Cl. ..... 84/1.24; 84/DIG. 4; 84/DIG. 1; 84/DIG. 17

[58] Field of Search .... 84/DIG. 1, DIG. 4, DIG. 17, 84/1.24, 1.25; 179/1 E, 1 J

[56] References Cited

U.S. PATENT DOCUMENTS 4,167,651 9/1979 Kempe ..... 179/1 J 4,189,971 2/1980 Mantani ..... 84/DIG. 4

*Primary Examiner*—F. W. Isen

*Attorney, Agent, or Firm*—Neuman, Williams, Anderson & Olson

[57] ABSTRACT

The present invention is a single channel string ensemble sound system for an electronic organ having a keyboard formed by a plurality of keys and a signal generating means responsive to the depression of the keys. The sound system comprises an electronic mixer, an amplifier, a first transducer and a second transducer, wherein the first transducer is driven by the output of the amplifier while the second transducer is driven approximately 180° out of phase electronically by the same output, and wherein the second transducer is physically oriented in a plane approximately 90° from the plane of the first transducer or speaker.

3 Claims, 2 Drawing Figures

SINGLE CHANNEL STRING ENSEMBLE SOUND SYSTEM FOR AN ELECTRONIC MUSICAL INSTRUMENT

BACKGROUND OF THE INVENTION

1. Field of the Invention

The present invention is an improved system for generating string ensemble sounds in an electronic musical instrument, specifically an electronic organ. In playing the electronic organ it is often desirable to simulate the sound generated by a multiplicity of stringed instruments, as in a string ensemble. It is difficult to artificially simulate the sound of a string ensemble because: (a) when a stringed instrument is played it produces a complex sound waveform comprising a fundamental frequency and several additional harmonics which are multiples of that fundamental frequency; (b) when several stringed instruments are played together in an ensemble each instrument generates a sound waveform which is slightly out of phase with that of the accompanying instruments since each musician plays at a slightly different time and/or speed even when each musician is playing the same note; and (c) the sound produced by each instrument reaches the listener at a slightly different time due to the different spacial relationship between the listener and each instrument. Accordingly, the fundamental and harmonic waveforms generated by each stringed instrument interact with the waveforms produced by the accompanying string instruments to acoustically cancel and reinforce one another resulting in the distinctive sound characteristics of a string ensemble. This acoustic phenomenon is particularly noticeable to the listener due to the directional nature of the predominately high frequency sounds produced by a string ensemble.

2. Description of the Prior Art

The prior art recognizes the need for providing an electronic organ with means for producing string ensemble sounds. In some prior art electronic organs string ensemble sounds are simulated by use of multiple channel amplifier and speaker systems. The independent production of sound through each channel of such system results in the acoustical cancellation and reinforcement characteristic of a good string ensemble sound. The cost of the additional components and the cost associated with the manufacture and production of such multiple channel systems, however, can be substantial and frequently results in the organ manufacturer providing a string ensemble feature on only the more expensive organ models.

Less expensive electronic organs of the prior art employ a single channel amplifier circuit and a single speaker system. These single channel electronic organs attempt to provide a string ensemble effect by electronically mixing separate, modulated input signals. Acoustically, however, such single channel systems do not approach in quality the desirable presence and modulation effects produced by the more expensive multiple channel electronic organs.

It is therefore a general object of this invention to provide a single channel string ensemble sound system for electronic organs which overcomes the disadvantages of the prior art string ensemble sound systems.

Another object of this invention is to provide a single channel string ensemble sound system which is lower in cost than, but comparable in quality to, the prior art multiple channel string ensemble sound systems.

Another object of this invention is to provide a single channel string ensemble sound system for electronic organs which can generate sounds which acoustically cancel and reinforce one another in a manner which results in good string ensemble sound.

Another object of this invention is to provide a single channel string ensemble sound system which receives a signal representing string ensemble sounds, electronically mixes and amplifies the signal and drives two transducers substantially 180° out of phase electronically with the mixed signal with the two transducers being positioned at substantially right angles to each other.

Other objects of this invention will become apparent upon reading the following summary of the invention, the detailed description and appended claims, and upon reference to the accompanying drawings.

SUMMARY OF THE INVENTION

The present invention is a sound system for use in an electronic organ having a keyboard formed by a plurality of keys and a signal generating means responsive to the depression of the keys. The sound system comprises an electronic mixer, an amplifier, a first transducer and a second transducer, said transducers being capable of transforming electronic signals to audible sound waves. The signal generating means, which are activated by depressing a key on the keyboard, supplies the mixer with an electric input signal having a given fundamental frequency which corresponds to the depressed key, in addition to the harmonic overtones of the fundamental frequency which are appropriate for producing a stringed instrument waveform. The mixer, in turn, through the use of bucket brigade circuits or other time delay circuitry well known to those skilled in the art, converts the input signal into a single phase shifted output signal. The output signal from the mixer is then amplified by a single channel amplifier. The first transducer is driven by the output of the amplifier, while the second transducer is driven approximately 180° out of phase electronically by the same output. The second transducer is physically oriented in a plane approximately 90° from the plane of the first transducer or speaker. This system produces an acoustically enhanced string ensemble sound because of the acoustic cancellation and reinforcement provided by the physical arrangement of the transducers combined with their acoustical phase relationship to each other.

DETAILED DESCRIPTION OF THE DRAWINGS INCLUDING PREFFERRED EMBODIMENTS

Figure 1:
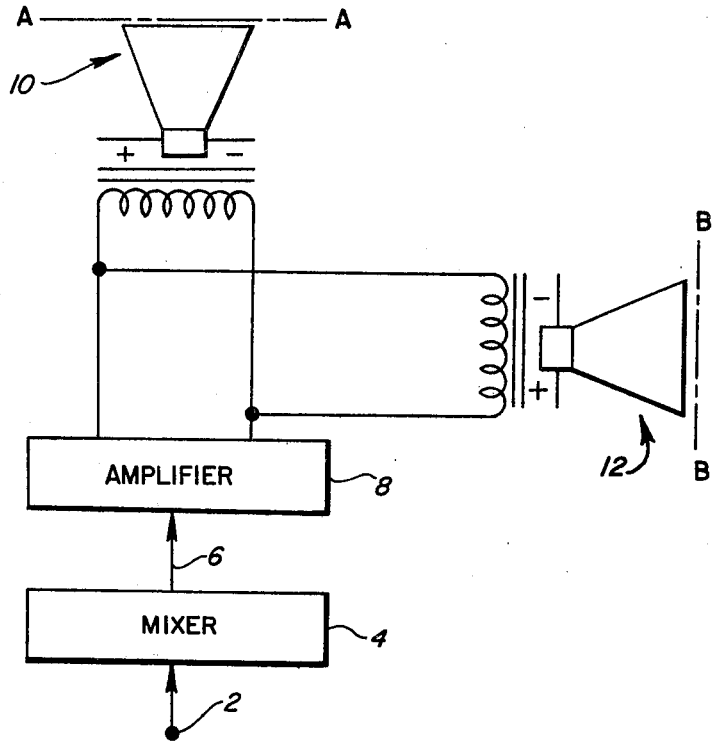
FIG. 1 is a schematic diagram in partial block form of the single channel string ensemble sound system of the present invention.

Turning first to FIG. 1, there is shown a schematic diagram of one embodiment of the present invention in partial block form. An input signal 2 is supplied to the mixer 4 by signal generating means (not shown). The signal generating means may be any means well known to those of ordinary skill in the art, said means being responsive to the keyboard of an electronic organ and capable of producing an input signal having a stringed instrument waveform. The mixer 4, through electronic circuitry well known to those of ordinary skill in the art, divides the input signal 2 into at least two separate signals, phase shifts at least one of those separate signals with respect to the other, and then electronically recombines the phase shifted signals into a single phase shifted output signal 6.

The output signal 6 is then received by single channel amplifier 8. The single channel amplifier 8 electronically increases the amplitude of the single phase shifted output signal 6 to provide an amplified phase shifted output signal to drive a first transducer 10 and to drive a second transducer 12.

The first transducer 10 and the second transducer 12 may each be any device capable of converting an electrical signal to an audible sound wave, for example, a moving coil speaker. As shown in FIG. 1 by the indicated (+) and (−) polarities, the first transducer 10 is connected in circuit to the amplifier 8 so as to be driven substantially 180° out of phase electronically in relation to the second transducer 12. In addition, the second transducer 12 is physically oriented in a plane B—B spaced substantially 90° from the plane A—A of the first transducer 10 so that the acoustic cancellation and reinforcement which results from the interaction of the sound waves provided by the first transducer 10 and the second transducer 12 is such that the resulting sound closely resembles the sound produced by a string ensemble.

Figure 2:
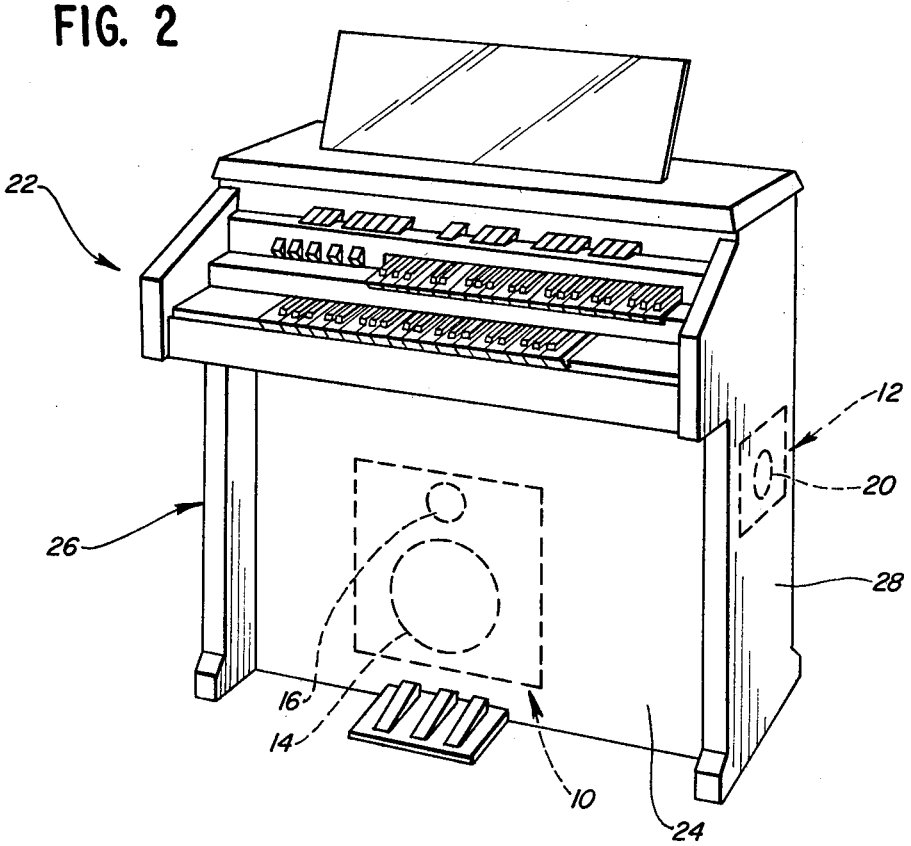
FIG. 2 is a perspective view of the single channel string ensemble sound system of the present invention in its environment.

Turning now to FIG. 2, an electronic organ 22 with one embodiment of the present invention is shown in perspective view. The first transducer 10 is a speaker system comprising a bass reflex speaker 14 which is responsive to low range and lower middle range frequency signals and a first tweeter speaker 16 which is responsive to high range and upper middle range frequency signals. The second transducer 12 is a second tweeter speaker 20. The bass reflex speaker 14 and first tweeter speaker 16 are fixedly mounted in the front wall 24 of the cabinet 26 of the electronic organ 22 such that they radiate sound waves directly to a listening audience (not shown), whereas the second tweeter speaker 20 is fixedly mounted in side wall 28 of the cabinet 26 so that it radiates sound waves substantially at right angles to the sound waves radiated by the bass reflex speaker 14 and the first tweeter speaker 16.

Sound waves radiated by the first transducer 10 in general reach the listening audience directly, that is without significant reflection, whereas the sound waves radiated by the second transducer 12 in general reach the listening audience after being reflected from the walls of the room or other objects. This is particularly significant where relatively high-frequency sound waves are being radiated, as when a stringed instrument sound is being produced, because of the highly directional nature of high frequency sound waves. The highly directional nature of such sound waves also increases the difficulty of producing a good string ensemble sound because of their tendency to travel in a single direction without interacting with other sound waves. The physical and electrical arrangement of the first transducer 10 and second transducer 12, however, provides a system whereby effective interaction occurs despite the use of only a single channel amplifier.

From the above description it is apparent that the objects of the present invention have been achieved. While only certain embodiments have been set forth, alternative embodiments and various modifications will be apparent to those skilled in the art. For example, each transducer of the single channel string ensemble sound system of the present invention could comprise a plurality of speakers. These and other alternatives are considered equivalents and within the spirit and scope of the present invention.

Having described the invention, what is claimed is:

1. A single channel sound system for use in an electronic organ having a keyboard and a signal means responsive to the depression of keys on said keyboard for generating electric signals representing the waveforms produced by a string instrument, said single channel sound system being responsive to said electric signals for generating string ensemble tones for a listening audience and comprising:

a mixer circuit for receiving said electric signals representing the waveforms produced by string instruments and dividing said signals into at least two separate signals, phase shifting at least one of said separate signals with respect to the other separate signal and combining said separate phase shifted signal and said other separate signal into a phase shifted output signal;

an amplifier connected in circuit to said mixer circuit for receiving said phase shifted output signal and providing an amplified phase shifted output signal;

a first transducer driven by said amplified phase shifted output signal and physically oriented in a plane to directly radiate sound waves toward the listening audience;

a second transducer driven by said amplified phase shifted output signal substantially 180° out of phase electronically from said first transducer and physically oriented in a plane to radiate sound waves by reflection toward the listening audience;

said plane of said second transducer is substantially perpendicular to said plane of said first transducer for providing sound waveforms from said first transducer and said second transducer which, in addition to being 180° out of phase, acoustically cancel and reinforce each other providing both direct and reflected sound waveforms to the listening audience which simulate the actual waveforms produced by a string ensemble.

2. The single channel sound system of claim 1 wherein said first transducer comprises a speaker system having at least one high frequency range speaker and at least one lower frequency range speaker.

3. The single channel sound system of claim 1 or 2 wherein said second transducer comprises at least one high frequency range speaker.

* * * * *